United States Patent [19]

Allen et al.

[11] Patent Number: 4,579,196

[45] Date of Patent: Apr. 1, 1986

[54] LINEMAN'S SAFETY STRAP

[76] Inventors: Kimberley J. Allen, 47 Lakeview Ave., Toronto, Ontario, Canada, M6J 3B4; Roger H. DePlancke, R.R. #2, Orillia, Ontario, Canada, L3V 6H2

[21] Appl. No.: 601,067

[22] Filed: Apr. 16, 1984

[30] Foreign Application Priority Data

Apr. 29, 1983 [CA] Canada ..... 426977

[51] Int. Cl.[4] ..... A62B 35/00

[52] U.S. Cl. ..... 182/9

[58] Field of Search ..... 182/9, 3, 4

[56] References Cited

U.S. PATENT DOCUMENTS

| | | | |
|---|---|---|---|
| 869,382 | 10/1907 | Newton | 182/9 |
| 1,120,496 | 12/1914 | Holsclaw | 182/9 |
| 1,504,030 | 8/1924 | Dettweiler | 182/9 |
| 1,721,516 | 7/1929 | Jacobs | 182/9 |
| 2,753,100 | 7/1956 | Montgomery | 182/9 |
| 3,407,898 | 10/1968 | Johnson | 182/9 |
| 3,840,091 | 10/1974 | Conlon | 182/9 |

*Primary Examiner*—Reinaldo P. Machado
*Attorney, Agent, or Firm*—Ridout & Maybee

[57] ABSTRACT

A lineman's safety strap comprises an outer strap connected to the lineman's body belt and extending around the outer face of a pole to be climbed, and an inner strap extending between end portions of the outer strap across the inner face of the pole. The outer strap has inwardly and downwardly directed teeth which, in the event of a fall, bite into the pole, the inner strap bearing against the opposite face of the pole and cooperating with the toothed outer strap to support the lineman.

8 Claims, 5 Drawing Figures

FIG. 3
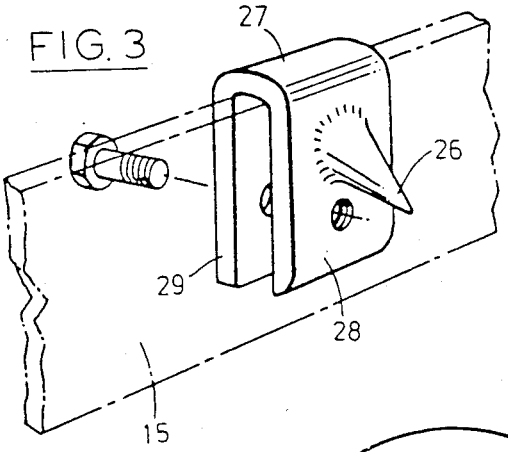
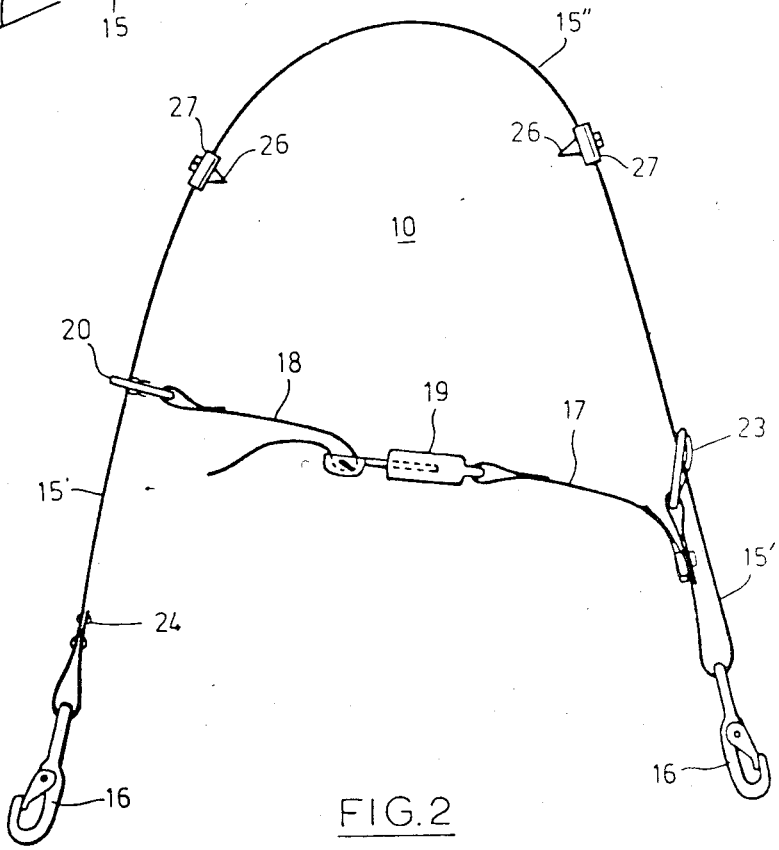
FIG. 2

FIG. 4
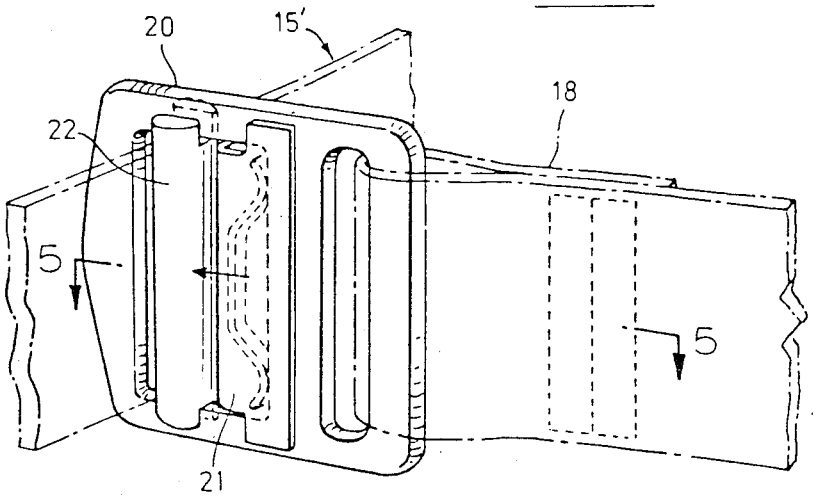
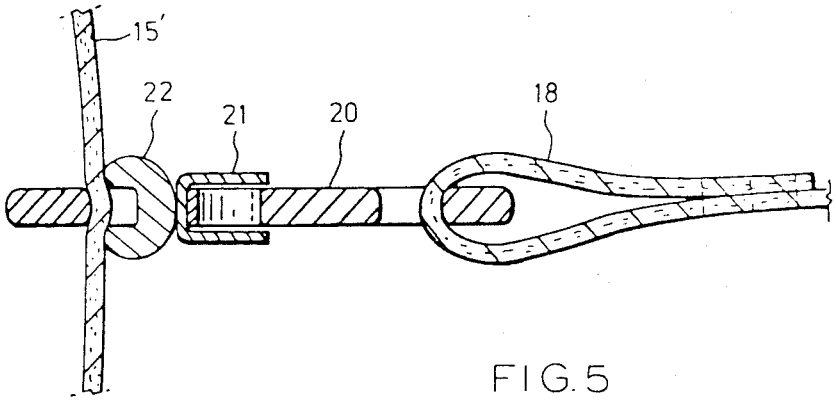
FIG. 5

LINEMAN'S SAFETY STRAP

This invention relates to safety straps for use more particularly by linemen and others who in the course of their work are required to climb utility poles and the like.

To assist climbing a lineman usually wears climbers fitted with spurs or gaffs which penetrate the pole to prevent the feet from slipping, and to support the lineman in his working position on the pole a safety strap is worn, the safety strap extending round the outer face of the pole and being attached at its ends to attaching rings on a body belt or harness which the lineman normally wears. The safety strap is normally of relatively stiff but flexible material, such as resin treated latex nylon safety strapping material, or Latigo leather, so that the loop which extends around the pole will retain its form when in use and be capable of being tipped upwardly during climbing.

It is necessary that the safety strap should be capable of supporting the weight of the lineman, if he should slip, by engaging the outer face of the pole so as to resist downward movement. Various systems have been devised for this purpose, but the problem of ensuring secure engagement with poles without hardware and wet or icy poles remains. The problem is accentuated by the requirement that any ancillary safety devices must not unduly encumber the lineman in his work, since otherwise they will not gain acceptance.

The inventors have devised and experimented with various modifications to the currently used safety strap designs. One modification was to fit a releasable tie strap between the end portions of the main strap so as to extend across the inner face of the pole thereby forming a closed loop around it. However, it was found that the strap and main strap did not provide sufficient restraint to support the lineman in the event of a fall. Another modification was to provide teeth or cleats projecting from the inside surface of the safety strap with the object that these teeth would bite into the outer face of the pole thereby to provide positive support when required. This modification was further improved by arranging the teeth so as to extend inwardly and downwardly from the strap. However, even this improved version was found to be unreliable. Further experiment showed that this latter modification used in conjunction with a releasable inner tie strap was most reliable and afforded ample security without unduly encumbering the lineman.

According to the present invention, therefore, there is provided a lineman's safety strap for use in association with a body belt having attaching rings, comprising an outer strap of relatively stiff but flexible material adapted to extend loosely around a pole to be climbed and having end portions providing end attachment means for attachment to said attaching rings, the outer strap having an intermediate portion carrying inwardly and downwardly directed teeth adapted to bite into the pole when pulled thereagainst, and an inner strap releasably attached to and extending between said end portions, said inner strap cooperating with said intermediate portion of the outer strap to form therewith a closed loop encircling the pole whereby in the event of a fall the inner strap bears against the inner face of the pole while the teeth are pulled into biting engagement with the outer face.

A preferred embodiment of the invention is illustrated in the accompanying drawings, in which:

FIG. 2 is a plan view of the safety strap showing its component parts;

FIG. 3 shows a detail of the outer strap;

FIG. 4 shows the mode of attachment of one end of the inner strap to a respective end portion of the outer strap; and FIG. 5 is a section on line 5—5 in FIG. 4.

Figure 1:
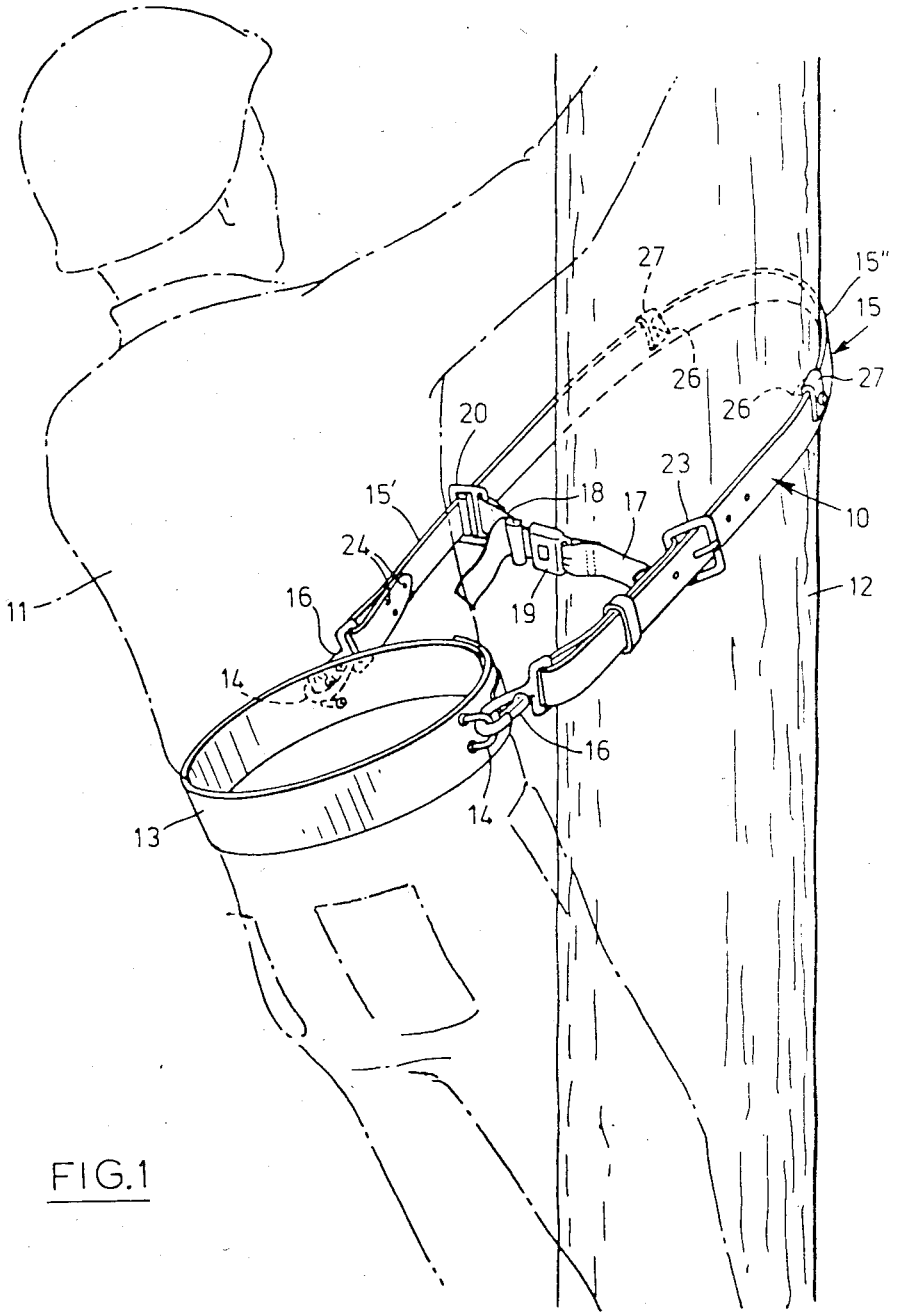
FIG. 1 shows the safety strap comprising inner and outer straps in use as worn by a lineman.

FIG. 1 shows a safety strap 10 worn by a lineman 11 who is climbing a wooden utility pole 12. The lineman 11 wears conventional climbing equipment including climbers (not shown) and a body belt 13 has attaching rings 14, or D-rings, at its sides, to which the safety strap is attached.

The safety strap 10 comprises essentially an outer strap 15 of relatively stiff but flexible material such as resin treated latex nylon web of the type commonly used in such strapping, the web being typically $1\frac{5}{8}$ inches wide. This strap is described in Canadian Standard Association Specification Z259.3. The outer strap is adapted to extend loosely round the pole 12, and has end portions 15' providing belt snaps 16 at their ends for engagement with the D-rings 14.

A pair of flexible strap segments 17, 18 are connected respectively to the outer strap end portions 15' and are interconnected by a spring-loaded quick release buckle 19 of the type commonly used in automobile seat belts. The strap segments, when so interconnected, thus form an inner strap which extends between the end portions 15' across the inner face of the pole. The strap segment 17 is adjustable in length, and is connected to the one strap end portion 15' by means of a spring-loaded sliding buckle 20, as shown in detail in FIGS. 4 and 5. The clamping members 21, 22 of the buckle 20 clamp the outer strap end portion so as to hold the buckle frictionally at a selected location therealong while permitting manual repositioning of the buckle along the strap.

The outer strap 15 is also adjustable in length, for which purpose a safety buckle 23 attached to a return portion of the strap is provided. Each end of the outer strap is threaded through the eye of a respective belt snap 16 around a shock absorbing element, to provide a return portion which is secured to the strap by rivets 24 or the buckle 23.

The outer strap 15 provides an intermediate portion 15'' extending between the end portion 15' so as to form the loop which extends round the pole 12. A pair of inwardly and downwardly directed teeth 26 extend from the inside surface of said intermediate portion 15''. These teeth are adapted to bite into the outer face of the pole when pulled against it. As shown in FIG. 3, each of the inwardly and downwardly directed teeth 26 is of bird's beak configuration and is mounted on a rigid support plate 27. The support plate 27, or cleat, is doubled so as to provide a pair of opposed plate portions 28, 29 between which the strap 15 is clamped and secured in place by a screwbolt 30. The tooth 26 is welded to the inner plate portion 28 so as to extend inwardly and downwardly therefrom. The plate portions 28, 29 extend from the upper edge of the strap 15 for more than half the strap width so as to provide stable anchorage for the tooth.

When the safety strap is to be used in the manner shown in FIG. 1, the lineman will first adjust the outer strap 15 to a convenient length using the buckle 23.

Before climbing the pole 12 he will first extend the outer strap loosely round the pole and then attach the belt snaps 16 to the D-rings 14. The inner strap segments 17, 18 are next interconnected so as to form with the outer strap a closed loop around the pole, the inner strap being suitably adjusted for length and suitably positioned with respect to the pole by adjusting the position of the sliding buckle 20 as necessary. In climbing the lineman flips the outer strap upwardly to the position shown in FIG. 1 periodically to allow freedom of movement for each increment of the climb.

If the climber loses his footing and begins to fall, the inwardly directed teeth are pulled tightly against the outer face of the pole and bite into it, thus defining an axis about which the loop formed by the outer strap pivots until the inner strap 17, 18 is brought into engagement with the inner face of the pole. In this condition the inner and outer straps cooperate by jamming against the pole, the jamming action being assisted by the weight of the lineman, who is thus securely supported until he can regain his footing, or be rescued.

We claim:

1. A lineman's safety strap for use in association with a body belt having attaching rings, comprising:

an outer strap of relatively stiff but flexible material adapted to extend loosely around a pole to be climbed and having end portions providing end attachment means for attachment to said attaching rings, the outer strap having an intermediate portion carrying inwardly and downwardly directed teeth adapted to bite into the pole when pulled thereagainst, the teeth being mounted on rigid support plates rigidly secured to the outer strap at predetermined positions on said intermediate portion, the support plates extending from the upper edge of said outer strap and downwardly across more than half the strap width, and an inner strap releasably attached to and extending between said end portions, said inner strap cooperating with said intermediate portion of the outer strap to form therewith a closed loop encircling the pole whereby in the event of a fall the inner strap bears against the inner face of the pole while the teeth are pulled into biting engagement with the outer face.

2. A lineman's safety strap according to claim 1, wherein the inwardly and downwardly directed teeth are of bird-beak configuration.

3. A lineman's safety strap according to claim 1, wherein the end attachment means comprise snap hooks for attachment to the attaching rings.

4. A lineman's safety strap according to claim 1, wherein the inner strap is adjustable in length.

5. A lineman's safety strap according to claim 1, wherein the inner strap comprises a pair of strap segments respectively attached to said outer strap end portions and interconnected by a spring-loaded quick release buckle, one strap segment being attached to the respective said end portion by an adjustable sliding buckle engaging said respective end portion, for adjusting the size of said loop.

6. A lineman's safety strap according to claim 1, wherein said end attachment means are adapted to absorb a portion of the shock in the event of a fall.

7. A lineman's safety strap for use in association with a body belt having attaching rings, comprising:

an outer strap of relatively stiff but flexible material adapted to extend loosely around a pole to be climbed and having end portions providing end attachment means for attachment to said attaching rings, the outer strap having an intermediate portion carrying inwardly and downwardly directed teeth adapted to bite into the pole when pulled thereagainst, and an inner strap releasably attached to and extending between said end portions, said inner strap cooperating with said intermediate portion of the outer strap to form therewith a closed loop encircling the pole whereby in the event of a fall the inner strap bears against the inner face of the pole while the teeth are pulled into biting engagement with the outer face, wherein the inner strap comprises a pair of strap segments respectively attached to said outer strap end portions and interconnected by a spring-loaded, quick release buckle.

8. A lineman's safety strap according to claim 7, wherein one strap segment is attached to the respective end portion by an adjustable sliding buckle engaging said respective end portion, for adjusting the size of said loop.

* * * * *